US012765603B2

(12) United States Patent
Batista et al.

(10) Patent No.: US 12,765,603 B2
(45) Date of Patent: Oct. 20, 2026

(54) HEATER FOR AEROSOL-GENERATING DEVICE WITH MULTIPLE SUSCEPTOR SETS

(71) Applicant: Philip Morris Products S.A., Neuchatel (CH)

(72) Inventors: Rui Nuno Rodrigues Alves Batista, Morges (CH); Ricardo Cali, Mannheim (DE)

(73) Assignee: Philip Morris Products S.A., Neuchatel (CH)

( * ) Notice: Subject to any disclaimer, the term of this patent is extended or adjusted under 35 U.S.C. 154(b) by 418 days.

(21) Appl. No.: 18/253,295

(22) PCT Filed: Nov. 19, 2021

(86) PCT No.: PCT/EP2021/082246
§ 371 (c)(1),
(2) Date: May 17, 2023

(87) PCT Pub. No.: WO2022/112112
PCT Pub. Date: Jun. 2, 2022

(65) Prior Publication Data

US 2024/0090576 A1 Mar. 21, 2024

(30) Foreign Application Priority Data

Nov. 24, 2020 (EP) ..... 20209493

(51) Int. Cl.
*A24F 40/465* (2020.01)
*A24F 40/20* (2020.01)
(Continued)

(52) U.S. Cl.
CPC ..... *A24F 40/465* (2020.01); *A24F 40/20* (2020.01); *A24F 40/46* (2020.01); *A24F 40/60* (2020.01)

(58) Field of Classification Search
None
See application file for complete search history.

(56) References Cited

U.S. PATENT DOCUMENTS

2018/0279681 A1 10/2018 Rojo-Calderon et al.
2020/0093172 A1 3/2020 Liu
(Continued)

FOREIGN PATENT DOCUMENTS

CN 103653258 A 3/2014
CN 207040894 U 2/2018
(Continued)

OTHER PUBLICATIONS

Combined Russian Office Action and Search Report issued Nov. 16, 2023 in Russian Patent Application No. 2023116546/03 (with English Translation), 15 pages.
(Continued)

*Primary Examiner* — Linda L Gray
(74) *Attorney, Agent, or Firm* — Oblon, McClelland, Maier & Neustadt, L.L.P.

(57) ABSTRACT

A heater assembly for an aerosol-generating device is provided, including: a heating chamber configured to heat an aerosol-forming substrate; a first set of two or more susceptors configured to heat a first heating zone of the heating chamber; and a second set of two or more susceptors configured to heat a second heating zone of the heating chamber, the first heating zone and the second heating zone being arranged at different longitudinal positions of the heating chamber. An aerosol-generating device including the heater assembly, and an aerosol-generating system including the aerosol-generating device and an aerosol-generating article, are also provided.

15 Claims, 4 Drawing Sheets

Figure 1A:
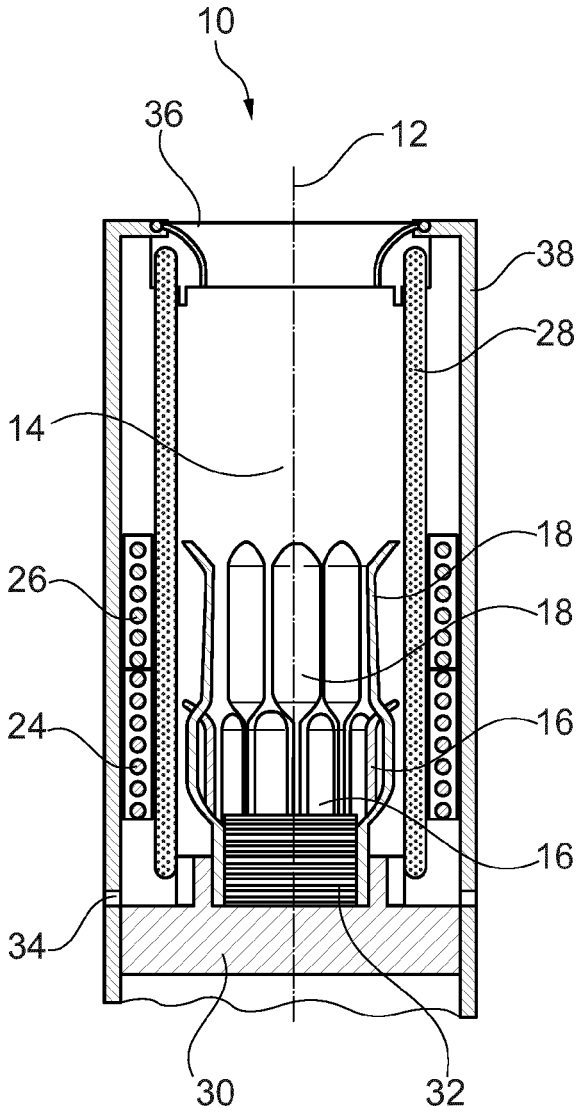

(51) Int. Cl.
*A24F 40/46* (2020.01)
*A24F 40/60* (2020.01)

(56) References Cited

U.S. PATENT DOCUMENTS

| | | | |
|---|---|---|---|
| 2020/0245683 | A1 | 8/2020 | Batista et al. |
| 2021/0112870 | A1 | 4/2021 | Park et al. |

FOREIGN PATENT DOCUMENTS

| | | | | | |
|---|---|---|---|---|---|
| CN | 108348004 | A | | 7/2018 | |
| CN | 110891441 | A | | 3/2020 | |
| JP | 2018-537957 | A | | 12/2018 | |
| JP | 2019-519201 | A | | 7/2019 | |
| JP | 2020-529214 | A | | 10/2020 | |
| KR | 10-2020-0016223 | A | | 2/2020 | |
| RU | 2 682 771 | C1 | | 3/2019 | |
| TW | 202037296 | A | | 10/2020 | |
| WO | WO-9527412 | A1 | * | 10/1995 | A24F 40/465 |
| WO | WO 2017/068099 | A1 | | 4/2017 | |
| WO | WO-2017068094 | A1 | * | 4/2017 | A24F 40/70 |
| WO | WO 2019/030000 | A1 | | 2/2019 | |
| WO | WO 2019/030361 | A1 | | 2/2019 | |
| WO | WO-2019030353 | A1 | * | 2/2019 | A24F 40/465 |
| WO | WO-2019234245 | A1 | * | 12/2019 | A24F 40/10 |
| WO | WO-2019238710 | A1 | * | 12/2019 | H05B 6/106 |
| WO | WO-2020025708 | A1 | * | 2/2020 | H05B 6/108 |
| WO | WO 2020/116798 | A1 | | 6/2020 | |
| WO | WO 2020/122409 | A1 | | 6/2020 | |
| WO | WO-2020120271 | A1 | * | 6/2020 | H05B 6/36 |
| WO | WO 2021/025332 | A1 | | 2/2021 | |
| WO | WO 2021/037826 | A1 | | 3/2021 | |

OTHER PUBLICATIONS

Combined Chinese Office Action and Search Report issued May 17, 2025, in corresponding Chinese Patent Application No. 202180071351.X (English Translation only), 7 pages.

International Search Report and Written Opinion issued on Feb. 24, 2022 in PCT/EP2021/082246 filed on Nov. 19, 2021, 15 pages.

International Preliminary Report on Patentability with Written Opinion issued on May 11, 2022 in PCT/EP2021/082246 filed on Nov. 19, 2021, 15 pages.

Japanese Office Action issued May 21, 2024 in Japanese Patent Application No. 2023-530888, 3 pages.

* cited by examiner

HEATER FOR AEROSOL-GENERATING DEVICE WITH MULTIPLE SUSCEPTOR SETS

The present disclosure relates to a heater assembly for an aerosol-generating device. The present disclosure further relates to an aerosol-generating device. The present disclosure further relates to an aerosol-generating system comprising an aerosol-generating device and an aerosol-generating article.

It is known to provide an aerosol-generating device for generating an inhalable vapor. Such devices may heat an aerosol-forming substrate contained in an aerosol-generating article without burning the aerosol-forming substrate. The aerosol-generating article may have a rod shape for insertion of the aerosol-generating article into a heating chamber of the aerosol-generating device. A heating element is arranged in or around the heating chamber for heating the aerosol-forming substrate once the aerosol-generating article is inserted into the heating chamber of the aerosol-generating device.

The aerosol-generating article should be securely held in the heating chamber during use. The aerosol-generating article should be held with sufficient force so it does not fall out of the heating chamber, as this would leave the device incapable of generating an aerosol.

It is known to use inductive heating whereby an alternating electrical current in an inductor coil induces an alternating magnetic field. This alternating magnetic field is referred to as an induction field, because it can induce alternating ring currents (eddy currents) in a susceptor if the susceptor is conductive. If the susceptor is magnetic, then hysteresis losses would occur in the susceptor. In a susceptor which is both electrically conductive and magnetic, both effects (eddy currents and hysteresis losses) will cause the susceptor to heat. Generally a material, which heats up when penetrated by an alternating magnetic field is called a susceptor. Heat generated in this manner is then propagated to the aerosol-generating substrate causing it to heat and therefore generate an aerosol. Some induction heating devices are designed to have multiple heating zones, i.e. the heating system is able to heat only a sub-portion of the full consumable. This may be, for example, to allow a single consumable to be used multiple times, or to allow a single consumable to provide a different user-experience depending on what sub-portion is used to generate an aerosol or just to achieve a more uniform user experience over a longer time period. It is known to use different inductor coils for heating different heating zones of a susceptor.

It would be desirable to have an aerosol-generating device that may reduce the amount of energy consumed by the heater assembly. It would be desirable to have an aerosol-generating device that may selectively heat a specific heating zone of a plurality of heating zones. It would be desirable to have an aerosol-generating device that may reduce thermal transfer between different heating zones. It would be desirable to have an aerosol-generating device that may reduce the thermal mass of the susceptor.

It would further be desirable to have an aerosol-generating device that may provide intimate thermal contact between a susceptor and an aerosol-forming substrate. It would be desirable to have an aerosol-generating device that may securely hold an aerosol-generating article in the heating chamber. It would be desirable to have an aerosol-generating device that may allow for an aerosol-generating article to be easily inserted into and removed from the heating chamber.

According to an embodiment of the invention there is provided a heater assembly for an aerosol-generating device. The heater assembly may comprise a heating chamber for heating an aerosol-forming substrate. The heater assembly may comprise a first set of susceptors configured for heating a first heating zone of the heating chamber. The heater assembly may comprise a second set of susceptors configured for heating a second heating zone of the heating chamber. The first heating zone and the second heating zone may be arranged at different longitudinal positions of the heating chamber.

According to an embodiment of the invention there is provided a heater assembly for an aerosol-generating device. The heater assembly comprises a heating chamber for heating an aerosol-forming substrate. The heater assembly comprises a first set of susceptors configured for heating a first heating zone of the heating chamber. The heater assembly further comprises a second set of susceptors configured for heating a second heating zone of the heating chamber. The first heating zone and the second heating zone are arranged at different longitudinal positions of the heating chamber.

By providing the heater assembly of the invention, the amount of energy consumed by the heater assembly may be reduced. By providing the heater assembly of the invention, a specific heating zone of a plurality of heating zones may be selectively heated. By providing the heater assembly of the invention, thermal transfer between different heating zones may be reduced. By providing the heater assembly of the invention, the thermal mass of the susceptor may be reduced.

By providing the heater assembly of the invention, intimate thermal contact between a susceptor and an aerosol-forming substrate may be achieved. By providing the heater assembly of the invention, an aerosol-generating device may be provided that securely holds an aerosol-generating article in the heating chamber. By providing the heater assembly of the invention, an aerosol-generating device may be provided that allows for an aerosol-generating article to be easily inserted into and removed from the heating chamber.

Preferably, the heater assembly is a component part of the aerosol-generating device.

The first heating zone may be arranged distal to the second heating zone with respect to the longitudinal axis of the heating chamber.

Having an individual set of susceptors for each heating zone may advantageously reduce thermal contact between the susceptors of different heating zones. Thereby, inadvertent heat transfer between different heating zones may be reduced. Containment of heat within a specific heating zone may advantageously be improved. Selective heating of individual heating zones may be improved. Heat losses between heating zones may be reduced. Energy consumption may be reduced.

As used herein, the term 'set of susceptors' refers to a plurality of susceptors meaning two or more susceptors, for example 3 or more, 4 or more, 5 or more, 6 or more, 7 or more, or 8 or more susceptors within one set. Having a plurality of susceptors for each heating zone may reduce the total mass of susceptor material in comparison to having one big single susceptor for the complete heating zone. This may reduce one or both of the thermal mass and the thermal inertia of the susceptor material for each heating zone. Thereby, less energy may be required to heat a heating zone to a desired temperature. Thereby, a heating zone may be heated more quickly to a desired temperature. Having a plurality of susceptors for each heating zone may improve the mechanical flexibility of the susceptor arrangement.

A susceptor of one or both of the first and second sets of susceptors may be flexible in a direction orthogonal to the longitudinal axis of the heating chamber for securely holding an aerosol-generating article after being inserted into the heating chamber. As used herein, a direction orthogonal to the longitudinal axis of the heating chamber corresponds to a transversal direction.

A susceptor of one or both of the first and second sets of susceptors may be elongate along a longitudinal axis of the heating chamber. A longitudinal axis of a susceptor of one or both of the first and second sets of susceptors may be collinear to a longitudinal axis of the heating chamber. This may advantageously provide transversal flexibility of the susceptor for gripping an aerosol-generating article.

There may be a gap between individual susceptors of one set of susceptors. Thereby, transversal airflow through the gap may be possible.

One or both of the first and second sets of susceptors may be arranged circumferentially around the heating chamber.

The susceptors of the first set of susceptors and the susceptors of the second set of susceptors may be arranged alternately, such that a susceptor of the first set is neighbored by two susceptors of the second set. The susceptors of the first set of susceptors and the susceptors of the second set of susceptors may be arranged alternately along a transversal circumferential direction, such that a susceptor of the first set is neighbored by two susceptors of the second set in the transversal circumferential direction.

A susceptor of one or both of the first and second sets of susceptors may comprise several portions. A susceptor may comprise a stem for mounting the susceptor onto a support base at its distal end thereof. A susceptor may comprise a heating portion for heating the aerosol-forming substrate of the aerosol-generating article. The heating portion may comprise a heating surface. The heating surface may be a flat portion configured to come into intimate thermal contact with the aerosol-generating article. A susceptor may comprise a tip portion at its proximal end thereof. The tip portion may be bent in a transversal direction orthogonal to a longitudinal direction of one or both of the susceptor and the heating chamber. Due to the bent tip portion of the susceptor, a flared arrangement of the set of susceptors may result. This may facilitate insertion of an aerosol-generating article into the heating chamber.

A gap may be provided between heating surfaces of the susceptors of the first set of susceptors and heating surfaces of the susceptors of the second sets of susceptors. A gap may be provided between heating surfaces of the susceptors within a set of susceptors.

At least a portion of a susceptor of one or both of the first and second sets of susceptors may comprise a curved shape along a longitudinal direction of the heating chamber. At least a portion of a susceptor of one or both of the first and second sets of susceptors may comprise a S-shape along a longitudinal direction of the heating chamber. The curved or S-shape may allow a susceptor to be configured such that only a heating portion or heating surface of the susceptor comes into intimate thermal contact with the aerosol-generating article in the respective heating zone.

A susceptor of the second set of susceptors may be longer, measured parallel to the longitudinal axis of the heating chamber, than a susceptor of the first set of susceptors.

A susceptor of one or both of the first and the second set of susceptors may comprise a thinner distal portion and a broader proximal portion. The thinner distal portion may be configured for mounting the susceptor in a fixture in the device, for example a common base. The thinner distal portion may add mechanical flexibility, meaning bendability, to one or both of the first and second sets of susceptors. The thinner distal portion may reduce heat transfer to the mounting fixture. Due to the reduced heat transfer, the fixture may not need to be made of expensive materials capable of withstanding excessive heat and may be made from cheaper materials such as hard plastic.

A susceptor of the second set of susceptors may form a paddle-like shape.

Heating surfaces of one or both of the susceptors of the first and second sets of susceptors may be arranged in a honey comb-like pattern.

The shape of a susceptor of the first set of susceptors may differ from the shape of a susceptor of the second set of susceptors. The material of a susceptor of the first set of susceptors may differ from the material of a susceptor of the second set of susceptors.

A susceptor may be completely made of materials that may be inductively heated. A portion of a susceptor may comprise a magnetically inert material. As used herein, the term 'magnetically inert material' refers to a material that does not substantially heat up, when penetrated by an alternating magnetic field. A portion of a susceptor may comprise a material which is not a susceptor material. This means that the portion is free of any susceptor material that is heatable by penetration with a varying magnetic field. Only the heating portion, or the heating surface, of the susceptor may comprise a susceptor material. For example, the heating surface may be coated by a susceptor material. Thus, when in use, more energy of a varying magnetic field may be available to heat the heating surface.

Magnetically inert materials may comprise minerals, epoxy resins, polyester, polyacrylamide, vinyl ester resin, wood, ceramic, alumina, zirconia, aramid, glass fibre, polyethylene, and glass-like materials.

As used herein, a portion of a susceptor that comprises a susceptor material and that is configured to be inductively heated is referred to as a 'susceptor element'.

As used herein, a 'susceptor element' is a conductive element that heats up when subjected to a changing magnetic field. This may be the result of eddy currents induced in the susceptor element, hysteresis losses, or both eddy currents and hysteresis losses. During use, the susceptor elements are located in thermal contact or close thermal proximity with the aerosol-forming substrate of an aerosol-generating article received in the heating chamber of the heater assembly of the aerosol-generating device. In this manner, the aerosol-forming substrate is heated by the susceptor elements such that an aerosol is formed.

Advantageously, providing a heating zone formed from a set of individual susceptors allows the size, position, or size and position of the heating zone to be easily varied by changing one or more of the size, position, shape, and pattern of the susceptors. When only a portion of a susceptor comprises the susceptor element, the rest of the susceptor may be formed from a non-susceptor material which may be lighter or cheaper than a susceptor material. In addition, a portion of the susceptor other than the susceptor element may be formed from a thermally insulative material. This may additionally allow heat generated in the susceptor element to remain concentrated in the heating zone. It may additionally reduce the amount of heat which is lost to other components of the aerosol-generating device. For example, it may additionally reduce the extent to which the housing of the aerosol-generating device is heated up during use.

As used herein, the terms 'thermally insulating' and 'thermally insulative' refer to a material having a bulk thermal conductivity of less than about 50 milliwatts per metre Kelvin (mW/(m K)) at 23° C. and a relative humidity of 50% as measured using the modified transient plane source (MTPS) method.

The susceptor element may comprise a foil or film of susceptor material applied on the heating surface of the susceptor. For example, a foil or film of susceptor material which is glued or welded to the heating surface.

The susceptor element may be a susceptor coating deposited on the heating surface. For example, the susceptor coating may be painted or printed onto the heating surface as a liquid. The susceptor coating may be deposited on the heating surface of the susceptor by a vacuum deposition process, such as evaporation deposition, or sputtering. The susceptor coating may be deposited on the heating surface by electrodeposition.

The susceptor element may be formed from any material that can be inductively heated to a temperature sufficient to aerosolise an aerosol-forming substrate. Suitable materials for the susceptor element include graphite, molybdenum, silicon carbide, stainless steels, niobium, aluminium, nickel, nickel containing compounds, titanium, and composites of metallic materials. Preferred susceptor elements comprise a metal or carbon. Advantageously the susceptor element comprises or consists of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than 5 percent, preferably more than 20 percent, more preferably more than 50 percent or more than 90 percent of ferromagnetic or paramagnetic materials. Preferred susceptor elements may be heated to a temperature in excess of 250 degrees Celsius.

The susceptor element may comprise a metal or a metal alloy. The susceptor element may be formed from a metal or a metal alloy.

Susceptor elements may comprise, or be made of, one or more of silicon carbide, molybdenum, graphite, stainless steel, a stainless steel alloy, Kovar®, copper, a copper tungsten alloy, a copper molybdenum alloy, and electroplated conductors, such as nickel, silver, gold, silver-platinum alloy, and a silver-palladium alloy. The susceptors may be made of one or more of silicon carbide, molybdenum, graphite, and stainless steel.

At least a portion of a susceptor may comprise, or be made of, a shape memory material. This may facilitate temporary gripping of an aerosol-generating article.

The first and second sets of susceptors may be mounted on a common base arranged at a distal end of the heating chamber. The common base may be ridged. The common base may comprise, or be made of, a thermally insulating material. Thereby, thermal transfer between the susceptors may be reduced. As described herein, preferred thermally insulating materials include, for example, heat resistant plastics, glass or polymer materials, preferably with air inclusions like a fibrous material, aerogels and foams.

The heater assembly comprises at least a first heating zone and a second heating zone. The heater assembly may comprise a plurality of heating zones. During use, different heating zones may be heated to different temperatures. The plurality of heating zones may be positioned directly adjacent to each other. The heater assembly may comprise different heating zones separated along the longitudinal axis of the heating chamber. This may allow the heating zones to be used to heat different parts of an aerosol-generating article in thermal proximity to the different sets of susceptors. For example, different parts of the same aerosol-forming substrate, or different aerosol-forming substrates, or an aerosol-forming substrate and an aerosol former of the aerosol-generating article.

The plurality of heating zones being spaced apart along the longitudinal axis of the heating chamber may allow the heating zones to be used to heat different parts of an aerosol-generating article in thermal proximity to different sets of susceptors without inadvertently heating adjacent parts of the aerosol-generating article. For example, heating spaced apart aerosol-forming substrates. For example, heating a first aerosol-forming substrate with a first heating zone and heating a second aerosol-forming substrate with a second heating zone without substantially heating the second aerosol-forming substrate with the first heating zone, or substantially heating the first aerosol-forming substrate with the second heating zone.

The plurality of heating zones may be formed from the same susceptor material or materials. One or more of the heating zones may be formed from susceptors having a different composition to the susceptors of at least one other heating zone, and thus different susceptor characteristics. With this arrangement, different heating profiles may be provided by the first and second heating zones by virtue of different susceptor characteristics of the first and second susceptor materials. The heat provided by each heating zone may be fine-tuned by selection of the susceptor material or materials forming part of each susceptor, or from which each susceptor is formed. This may also facilitate sequential heating of the susceptors. For example, by forming the heating zones from susceptor materials for which optimal heating occurs at different frequencies of alternating current. The first and second heating zones may have different temperature cycles.

The heater assembly may comprise additional sets of susceptors and additional longitudinally separated heating zones. For example, the heater assembly may comprise a third set of susceptors configured for heating a third heating zone of the heating chamber. The heater assembly may comprise a fourth set of susceptors configured for heating a fourth heating zone of the heating chamber.

The heater assembly may comprise a first inductor coil for heating the first heating zone and a second inductor coil for heating the second heating zone.

The heater assembly may comprise a single inductor coil for heating both the first and second heating zones.

The heater assembly may comprise one or more inductor coils for heating at least a portion of the susceptors of one or both of the first and second sets of susceptors. The heater assembly may comprise a first inductor coil for heating the first set of susceptors and a second inductor coil for heating the second set of susceptors. The heater assembly may comprise a single inductor coil for heating both the first set of susceptors and the second set of susceptors.

The magnetic axis of the one or more inductor coils may be at an angle to, that is, non-parallel with, the longitudinal axis of the heating chamber. In preferred embodiments, the magnetic axis of the one or more inductor coils is substantially parallel with the longitudinal axis of the heating chamber. This may facilitate a more compact arrangement. Preferably, at least a portion of the susceptors is substantially parallel with the magnetic axis of the one or more inductor coils. This may facilitate even heating of the susceptor elements or the susceptors by one or more inductor coils. In particularly preferred embodiments, the susceptors are substantially parallel with the magnetic axis of the one or more inductor coils and with the longitudinal axis of the heating chamber.

The invention further relates to an aerosol-generating device comprising the heater assembly as described herein.

The aerosol-generating device may comprise a controller connected to the one or more inductor coils and a power supply. The controller may be configured to control the supply of power to the inductor from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the one or more inductor coils. Current may be supplied to the one or more inductor coils continuously following activation of the aerosol-generating device or may be supplied intermittently, such as on a puff by puff basis. The electric circuitry may advantageously comprise DC/AC inverter, which may comprise a Class-D or Class-E power amplifier. The controller may be configured for independently controlling the first heating zone and the second heating zone. The controller may be configured for independently controlling a first inductor coil for heating the first heating zone and a second heating coil for heating the second heating zone.

The invention further relates to an aerosol-generating system comprising the aerosol-generating device comprising the heater assembly as described herein and an aerosol-generating article comprising an aerosol-forming substrate. The aerosol-generating article may be configured to be at least partly inserted into the heating chamber.

The aerosol-generating article may comprise a first aerosol-forming substrate being located at a first longitudinal position of the aerosol-generating article and being configured to be heated by the first set of susceptors at the first heating zone, when the aerosol-generating article is inserted into the heating chamber. The aerosol-generating article may comprise a second aerosol-forming substrate being located at a second longitudinal position of the aerosol-generating article and being configured to be heated by the second set of susceptors at the second heating zone, when the aerosol-generating article is inserted into the heating chamber.

The aerosol-generating article may comprise a hollow tubular substrate portion comprising the aerosol-forming substrate. The hollow tubular substrate portion may be formed from a tubular tobacco mat.

As used herein, the term 'aerosol-forming substrate' refers to a substrate capable of releasing volatile compounds that can form an aerosol. The volatile compounds may be released by heating or combusting the aerosol-forming substrate. As an alternative to heating or combustion, in some cases, volatile compounds may be released by a chemical reaction or by a mechanical stimulus, such as ultrasound. The aerosol-forming substrate may be solid or liquid or may comprise both solid and liquid components. An aerosol-forming substrate may be part of an aerosol-generating article.

As used herein, the term 'aerosol-generating article' refers to an article comprising an aerosol-forming substrate that is capable of releasing volatile compounds that can form an aerosol. An aerosol-generating article may be disposable.

As used herein, the term 'aerosol-generating device' refers to a device that interacts with an aerosol-forming substrate to generate an aerosol. An aerosol-generating device may interact with one or both of an aerosol-generating article comprising an aerosol-forming substrate, and a cartridge comprising an aerosol-forming substrate. In some examples, the aerosol-generating device may heat the aerosol-forming substrate to facilitate release of volatile compounds from the substrate. An electrically operated aerosol-generating device may comprise an atomiser, such as an electric heater, to heat the aerosol-forming substrate to form an aerosol.

As used herein, the term 'aerosol-generating system' refers to the combination of an aerosol-generating device with an aerosol-forming substrate. When the aerosol-forming substrate forms part of an aerosol-generating article, the aerosol-generating system refers to the combination of the aerosol-generating device with the aerosol-generating article. In the aerosol-generating system, the aerosol-forming substrate and the aerosol-generating device cooperate to generate an aerosol.

As used herein, the term 'longitudinal' is used to describe the direction along the main axis of the heater assembly, of an aerosol-generating device, of an aerosol-generating article, or of a component of the aerosol-generating device or an aerosol-generating article, and the term 'transverse' is used to describe the direction perpendicular to the longitudinal direction. When referring to the heating chamber, the term 'longitudinal' refers to the direction in which an aerosol-generating article is inserted into the chamber and the term 'transverse' refers to a direction perpendicular to the direction in which an aerosol-generating article is inserted into the chamber.

Generally, the heating chamber may have an open end in which an aerosol-generating article is inserted, and a closed end opposite the open end. In such embodiments, the longitudinal direction is the direction extending between the open and closed ends. In certain embodiments, the longitudinal axis of the heating chamber is parallel with the longitudinal axis of the aerosol-generating device. For example, where the open end of the chamber is positioned at the proximal end of the aerosol-generating device. In other embodiments, the longitudinal axis of the heating chamber is at an angle to the longitudinal axis of the aerosol-generating device, for example transverse to the longitudinal axis of the aerosol-generating device. For example, where the open end of the heating chamber is positioned along one side of the aerosol-generating device such that an aerosol-generating article may be inserted into the heating chamber in direction which is perpendicular to the longitudinal axis of the aerosol-generating device.

As used herein, the term 'proximal' refers to a user end, or mouth end of the aerosol-generating-device, and the term 'distal' refers to the end opposite to the proximal end. Similar, with respect to the heating assembly or a susceptor, the term 'proximal' refers to a direction closest to a user during use and the term 'distal' refers to a direction away from a user during use. Correspondingly, each of the aerosol-generating device, the heating assembly, the susceptors and the heating chamber have a proximal end and an opposite distal end. When referring to the heating chamber or the inductor coil, the term 'proximal' refers to the region closest to the open end of the heating chamber and the term 'distal' refers to the region closest to the closed end. The ends of the aerosol-generating device or the heating chamber may also be referred to in relation to the direction in which air flows through the aerosol-generating device. The proximal end may be referred to as the 'downstream' end and the distal end referred to as the 'upstream' end.

As used herein, the term 'length' refers to the major dimension in a longitudinal direction of the susceptor, of the heating chamber, of an aerosol-generating device, of an aerosol-generating article, or of a component of the aerosol-generating device, or of the aerosol-generating article.

As used herein, the term 'width' refers to the major dimension in a transverse direction of the susceptor, of the heating chamber, of an aerosol-generating device, of an aerosol-generating article, or of a component of the aerosol-generating device, or of the aerosol-generating article, at a particular location along its length. The term 'thickness' refers to the dimension in a transverse direction perpendicular to the width.

Below, there is provided a non-exhaustive list of non-limiting examples. Any one or more of the features of these examples may be combined with any one or more features of another example, embodiment, or aspect described herein.

Example A: A heater assembly for an aerosol-generating device, comprising

- a heating chamber for heating an aerosol-forming substrate;
- a first set of susceptors configured for heating a first heating zone of the heating chamber; and
- a second set of susceptors configured for heating a second heating zone of the heating chamber;
- wherein the first heating zone and the second heating zone are arranged at different longitudinal positions of the heating chamber.

Example B: The heater assembly according to Example A, wherein the first heating zone is arranged distal to the second heating zone with respect to the longitudinal axis of the heating chamber.

Example C: The heater assembly according to Example A or Example B, wherein a susceptor of one or both of the first and second sets of susceptors is elongate along a longitudinal axis of the heating chamber.

Example D: The heater assembly according to any of the preceding examples, wherein one or both of the first and second sets of susceptors are arranged circumferentially around the heating chamber.

Example E: The heater assembly according to Example D, wherein the susceptors of the first set of susceptors and the susceptors of the second set of susceptors are arranged alternately, such that a susceptor of the first set is neighboured by two susceptors of the second set.

Example F: The heater assembly according to any of the preceding examples, wherein a susceptor of one or both of the first and second sets of susceptors is flexible in a direction orthogonal to the longitudinal axis of the heating chamber for securely holding an aerosol-generating article after being inserted into the heating chamber.

Example G: The heater assembly according to any of the preceding examples, wherein at least a portion of a susceptor of one or both of the first and second sets of susceptors comprises a curved shape along a longitudinal direction of the heating chamber.

Example H: The heater assembly according to Example G, wherein at least a portion of a susceptor of one or both of the first and second sets of susceptors comprises a S-shape along a longitudinal direction of the heating chamber.

Example I: The heater assembly according to any of the preceding examples, wherein a susceptor of the second set of susceptors is longer, measured parallel to the longitudinal axis of the heating chamber, than a susceptor of the first set of susceptors.

Example J: The heater assembly according to any of the preceding examples, wherein a susceptor of the second set of susceptors comprises a thinner distal portion and a broader proximal portion.

Example K: The heater assembly according to any of the preceding examples, wherein a susceptor of the second set of susceptors forms a paddle-like shape.

Example L: The heater assembly according to any of the preceding examples, wherein heating surfaces of one or both of the susceptors of the first and second sets of susceptors are arranged in a honey comb-like pattern.

Example M: The heater assembly according to any of the preceding examples, wherein a gap is provided between heating surfaces of the susceptors of the first set of susceptors and heating surfaces of the susceptors of the second sets of susceptors.

Example N: The heater assembly according to any of the preceding examples, wherein a gap is provided between heating surfaces of the susceptors within a set of susceptors.

Example O: The heater assembly according to any of the preceding examples, wherein the shape of a susceptor of the first set of susceptors differs from the shape of a susceptor of the second set of susceptors.

Example P: The heater assembly according to any of the preceding examples, wherein the material of a susceptor of the first set of susceptors differs from the material of a susceptor of the second set of susceptors.

Example Q: The heater assembly according to any of the preceding examples, wherein the first and second sets of susceptors are mounted on a common base arranged at a distal end of the heating chamber.

Example R: The heater assembly according to any of the preceding examples, comprising a first inductor coil for heating the first set of susceptors and a second inductor coil for heating the second set of susceptors.

Example S: The heater assembly according to any of Examples A to Q, comprising a single inductor coil for heating both the first set of susceptors and the second set of susceptors.

Example T: The heater assembly according to any of the preceding examples, wherein at least a portion of a susceptor comprises, or is made of, one or more of silicon carbide, molybdenum, graphite, stainless steel, a stainless steel alloy, Kovar®, copper, a copper tungsten alloy, a copper molybdenum alloy, and electroplated conductors, such as nickel, silver, gold, silver-platinum alloy, and a silver-palladium alloy.

Example U: The heater assembly according to any of the preceding examples, wherein at least a portion of a susceptor comprises, or is made of, a shape memory material.

Example V: An aerosol-generating device comprising the heater assembly according to any of the preceding examples.

Example W: An aerosol-generating system comprising the aerosol-generating device according to Example V and an aerosol-generating article comprising an aerosol-forming substrate, wherein the aerosol-generating article is configured to be at least partly inserted into the heating chamber.

Example X: The aerosol-generating system according to Example W, wherein the aerosol-generating article comprises a first aerosol-forming substrate being located at a first longitudinal position of the aerosol-generating article and being configured to be heated by the first set of susceptors at the first heating zone, when the aerosol-generating article is inserted into the heating chamber, and a second aerosol-forming substrate being located at a second longitudinal position of the aerosol-generating article and being configured to be heated by the second set of susceptors at the second heating zone, when the aerosol-generating article is inserted into the heating chamber.

Features described in relation to one embodiment may equally be applied to other embodiments of the invention.

Figure 3:
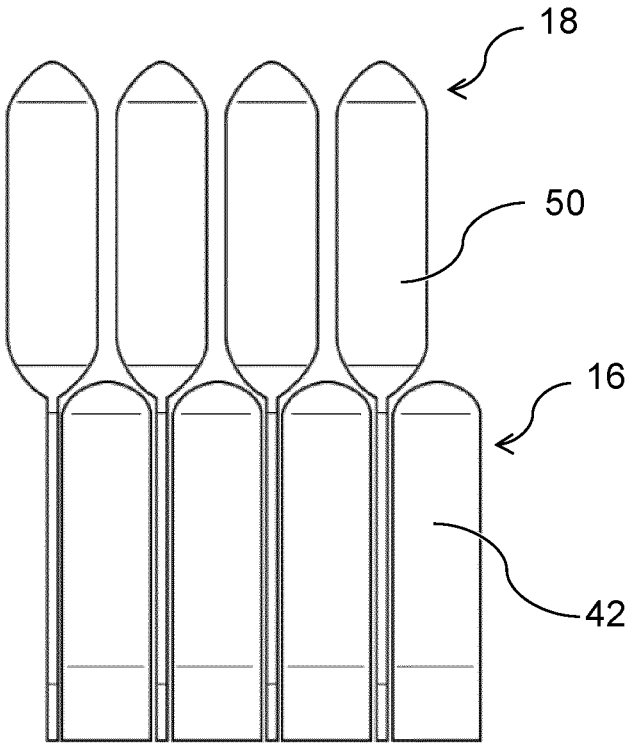

The invention will be further described, by way of example only, with reference to the accompanying drawings in which:

FIG. 1 shows a heater assembly of the invention;

FIGS. 2*a* to 2*f* show individual susceptors;

FIG. 3 show two sets of susceptors in an alternating arrangement; and

Figure 4A:
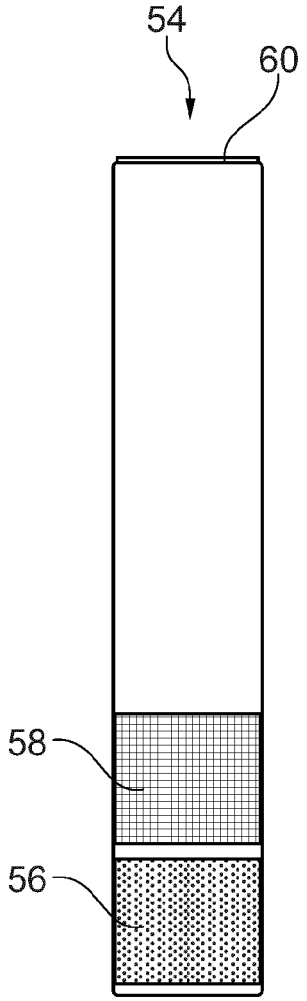
Figure 4B:
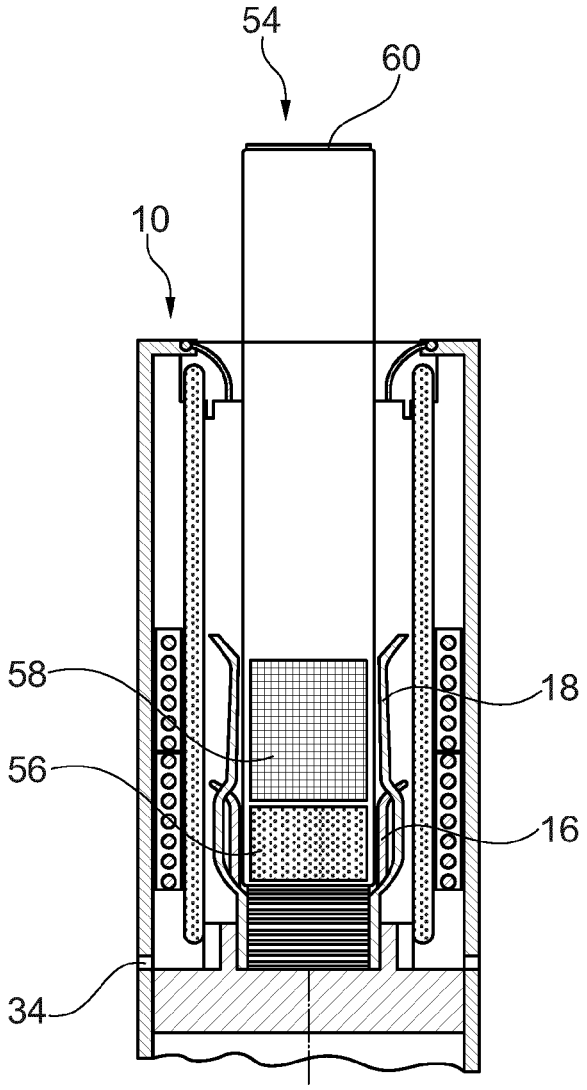

FIGS. 4*a* and 4*b* show an aerosol-generating article and the article being inserted into a heater assembly of the invention.

Figure 1B:
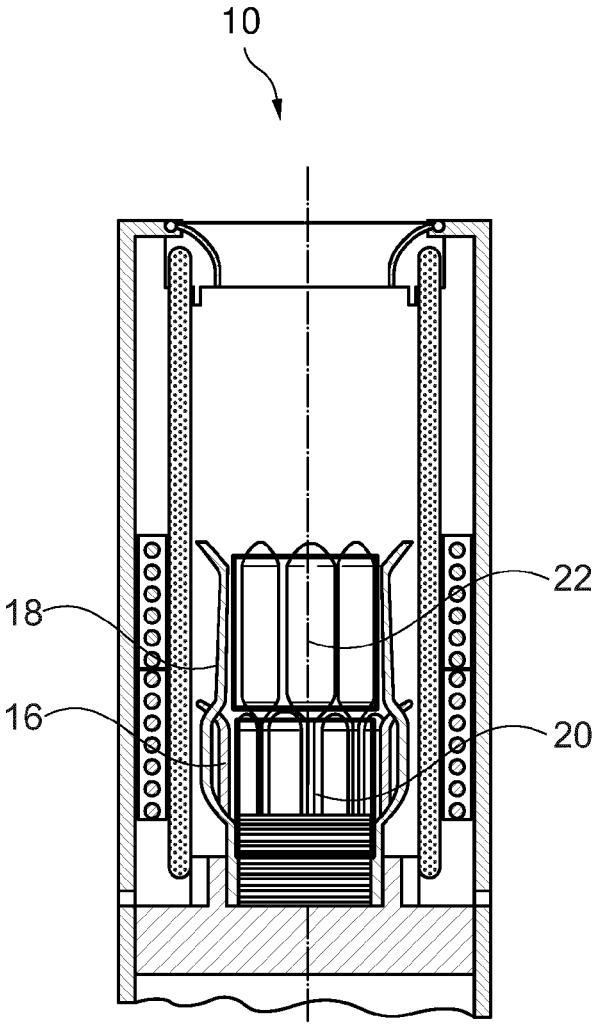

FIGS. 1*a* and 1*b* show a heater assembly 10 of the invention as being part of an aerosol-generating device in cross-sectional view. A dotted line indicates the central longitudinal axis 12 of the heater assembly 10. The heater assembly 10 comprises a heating chamber 14 for heating an aerosol-forming substrate of an aerosol-generating article. Two sets of susceptors, namely a first set of susceptors 16 and a second set of susceptors 18, are circumferentially arranged in a distal part of the heating chamber 14. FIGS. 1*a* and 1*b* show the same heater assembly 10. However, FIG. 1*b* visualizes that the first set of susceptors 16 is configured for heating a first heating zone 20 of the heating chamber 14 and a second set of susceptors 18 configured for heating a second heating zone 22 of the heating chamber 14. The first heating zone 20 and the second heating zone 22 are arranged at different longitudinal positions of the heating chamber 14. The heater assembly 10 further comprises a first inductor coil 24 for heating the first set of susceptors 16 and a second inductor coil 26 for heating the second set of susceptors 18. The first inductor coil 24 and the second inductor coil 26 are correspondingly arranged at different longitudinal positions of the heating chamber 14 coaxially surrounding the susceptor arrangement. Coaxially between the inductor coils 24, 26 and the susceptors 16, 18, a thermal insulator tube 28 is provided.

The susceptors 16, 18 are mounted on a ridged common support base 30 at a distal end of heating chamber 14. The heater assembly 10 also comprises a distal thermal insulator member 32, air inlets 34, a sealing member 36, and a housing 38.

The individual susceptors 16, 18 do not physically contact one another. There is a gap between neighbouring susceptors 16, 18. Thus, there are gaps between the susceptors 16, 18 of different sets of susceptors. Due to the gap between susceptors 16, 18 of different sets, thermal transfer between different heating zones is reduced.

There are also longitudinal gaps between the susceptors within one set. Due to the gap between susceptors within one set of susceptors, lateral airflow from air inlets 34 through the gap between the susceptors and into a central region of the heating chamber 14 at the central longitudinal axis 12 is made possible. This may advantageously improve aerosol-generation, particularly, when inserting an aerosol-generating article comprising a hollow tubular aerosol-forming substrate into the heating chamber 14.

FIGS. 2*a* to 2*f* show individual susceptors 16, 18 of the two sets of susceptors of the heater assembly 10 of FIGS. 1*a* and 1*b*. Each susceptor 16, 18 of both the first and second sets of susceptors 16, 18 is elongate along a longitudinal axis of the heating chamber.

Figure 2A:
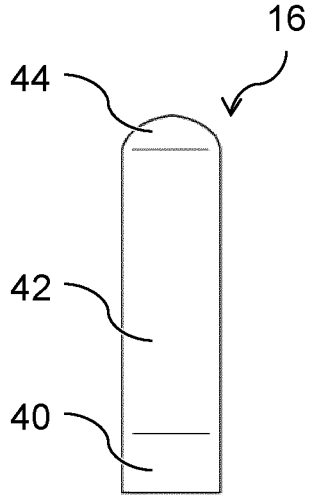
Figure 2B:
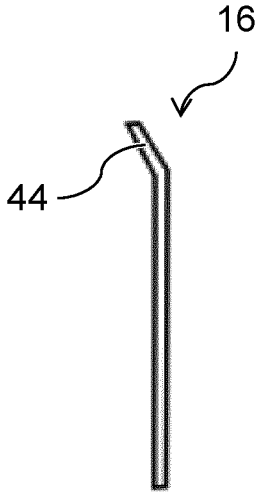
Figure 2C:
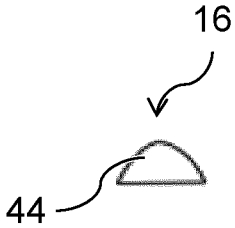

FIGS. 2*a* to 2*c* show a front view, a side view, and a top view, respectively, of a susceptor 16 of the first set of susceptors. The front view of FIG. 2*a* shows a susceptor 16 comprising a stem 40, a heating surface 42, and a tip 44. In the heater assembly of FIGS. 1*a* and 1*b*, the distal end of each susceptor 16 is mounted to the common support base 30 at the stem 40. When an aerosol-generating article is inserted into the heating chamber 14, the heating surface 42 comes into intimate thermal contact with the aerosol-forming substrate of the aerosol-generating article.

The side view of FIG. 2*b* and the top view of FIG. 2*c* show that the tip 44 is inclined. This results in a flared shape at the proximal end of the circumferentially arranged set of first susceptors 16 easing insertion of an aerosol-generating article.

Figure 2D:
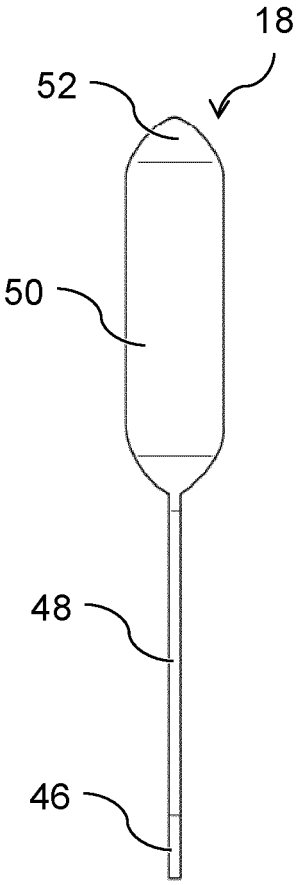
Figure 2E:
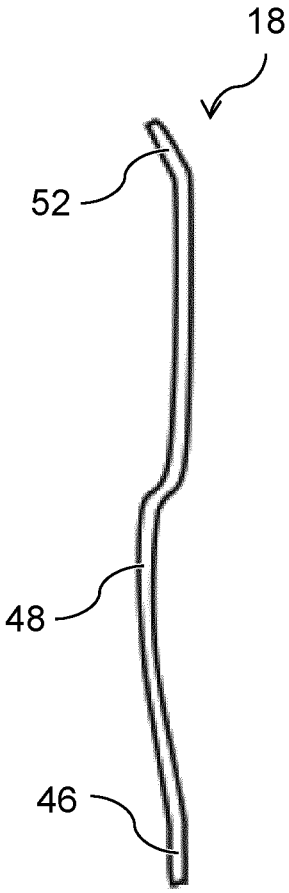
Figure 2F:
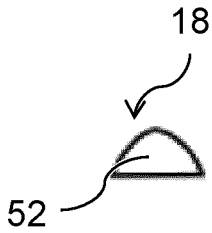

FIGS. 2*d* to 2*f* show a front view, a side view, and a top view, respectively, of a susceptor 18 of the second set of susceptors 18. A susceptor 18 of the second set of susceptors is longer, measured parallel to the longitudinal axis of the heating chamber, than a susceptor 16 of the first set of susceptors. The front view of FIG. 2*d* shows a susceptor 18 of the second set of susceptors 18 comprising a thinner distal portion and a broader proximal portion. The susceptor 18 forms a paddle-like shape. The susceptor 18 comprises a stem 46, a curved portion 48, a heating surface 50, and a tip 52. In the heater assembly of FIGS. 1*a* and 1*b*, the distal end of each susceptor 18 is mounted to the common support base 30 at the stem 46. The curved portion 48 has a curved shape along a longitudinal direction of the heating chamber. This results in a transversally protruding portion. The curved form of portion 48 is shown in the side view of FIG. 2*e*. In the assembled state, portion 48 is curved away from the longitudinal central axis of the heating chamber. A S-shape of the susceptor 18 along a longitudinal direction of the heating chamber 14 is shown. Thereby, when an aerosol-generating article is inserted into the heating chamber 14, only the heating surface 50 comes into intimate thermal contact with the aerosol-forming substrate of the aerosol-generating article. The second susceptors 18 advantageously do not contact and thus heat the aerosol-generating article in the area of the first heating zone 20.

The side view of FIG. 2*e* and the top view of FIG. 2*f* show that the tip 52 is inclined. This results in a flared shape of the circumferentially arranged set of second susceptors 18 easing insertion of an aerosol-generating article.

FIG. 3 visualizes the alternating arrangement of the first and second susceptors 16, 18 in the heater assembly of FIGS. 1*a* and 1*b*. Each susceptor 16 of the first set is neighbored by two susceptors 18 of the second set. FIG. 3 also shows that the heating surfaces 42, 50 of the susceptors 16, 18 of the first and second sets of susceptors are arranged in a honey comb-like pattern. FIG. 3 also shows the gaps between the individual susceptors. For ease of presentation, FIG. 3 shows the susceptors 16, 18 in a flat arrangement instead of the circumferential arrangement around the central axis 12 in the assembled state of FIGS. 1*a* and 1*b*.

Due to the elongate shape of the susceptors, and the susceptors being mounted to the common support base 30 at their stems 40, 46 thereof, the susceptors are flexible in a transverse direction, especially at their tips 44, 52 thereof. This spring-like flexibility of the susceptors 16, 18 facilitates insertion of an aerosol-generating article into the heating chamber 14. Also, the flexible susceptors 16, 18 provide improved gripping and securely holding of an inserted aerosol-generating article. Prior to an aerosol-generating article being inserted into the heating chamber 14, the distance between the closest point of the heating surfaces 42, 50 and the central axis 12 may be smaller than the diameter of the aerosol-generating article. However, when the aerosol-generating article is inserted into the induction heating chamber 14, the spring-like property of the susceptors 16, 18 pushes them transversally away from the central axis 12 and allows gripping of the aerosol-generating article in place without penetrating the aerosol-generating article. The heater surfaces 42, 50 thus push transversally against the aerosol-generating article to securely hold the aerosol-generating article and to provide intimate thermal contact. At the same time, the aerosol-generating article may be gently removed out of the heating chamber 14 by pulling it along the longitudinal axis 12. This may be additionally facilitated by the heater surfaces 42, 50 being configured to have a low coefficient of friction.

FIG. 4*a* shows an aerosol-generating article 54 for use with an aerosol-generating device comprising the heater assembly of the present invention. The aerosol-generating article 54 comprises a hollow cylindrical tube comprising two portions of solid aerosol-forming substrate 56, 58 at its distal end thereof and a mouthpiece including a mouthpiece filter (not shown) at its proximal end 60 thereof.

FIG. 4*b* shows the aerosol-generating article 54 of FIG. 4*a* being inserted into the heating chamber 14 of the heater assembly 10 of FIGS. 1*a* and 1*b*. The distal end of the aerosol-generating article 54 is inserted into the heating chamber 14 such that the hollow cylindrical tube of the aerosol-generating article 54 is circumferentially surrounded by the susceptor arrangement.

The first portion of aerosol-forming substrate 56 is surrounded by, and in intimate thermal contact with, the heating surfaces 42 of the susceptors 16 of the first set of susceptors. The first portion of aerosol-forming substrate 56 is arranged in the first heating zone 20. The second portion of aerosol-forming substrate 58 is surrounded by, and in intimate thermal contact with, the heating surfaces 50 of the susceptors 18 of the second set of susceptors. The second portion of aerosol-forming substrate 58 is arranged in the second heating zone 22.

During use, air may enter air inlets 34 and then propagate transversally through the gaps between the susceptors 16, 18 and further into the aerosol-forming substrate 56, 58. Formed aerosol may then transversally propagate into the hollow core of the aerosol-generating article 54 and then longitudinally propagate towards a mouthpiece at the proximal end 60 of the aerosol-generating article 54, where a user may inhale the aerosol.

The invention claimed is:

1. A heater assembly for an aerosol-generating device, comprising:

a heating chamber configured to heat an aerosol-forming substrate, the heating chamber including a longitudinal axis;

a first set of two or more susceptors configured to heat a first heating zone of the heating chamber;

a second set of two or more susceptors configured to heat a second heating zone of the heating chamber; and a first inductor coil arranged to heat the first set of susceptors and a second inductor coil arranged to heat the second set of susceptors, with the first inductor coil positioned at a different position along the longitudinal axis of the heating chamber from the second inductor coil, wherein the first heating zone and the second heating zone are arranged at different longitudinal positions of the heating chamber, wherein the first set of susceptors is spaced apart from the second set of susceptors such that the first set of susceptors is not connected to the second set of susceptors by a susceptor material, and wherein each susceptor in the first set of susceptors and the second set of susceptors is mounted on a common support.

2. The heater assembly according to claim 1, wherein a susceptor of one or both of the first and the second sets of susceptors is elongated along a longitudinal axis of the heating chamber.

3. The heater assembly according to claim 1, wherein one or both of the first and the second sets of susceptors are arranged circumferentially around the heating chamber.

4. The heater assembly according to claim 3, wherein the susceptors of the first set of susceptors and the susceptors of the second set of susceptors are arranged alternately, such that a susceptor of the first set is neighbored by two susceptors of the second set.

5. The heater assembly according to claim 1, wherein a susceptor of one or both of the first and the second sets of susceptors is flexible in a direction orthogonal to a longitudinal axis of the heating chamber and configured to hold an aerosol-generating article after being inserted into the heating chamber.

6. The heater assembly according to claim 1, wherein at least a portion of a susceptor of one or both of the first and the second sets of susceptors comprises a curved shape along a longitudinal direction of the heating chamber.

7. The heater assembly according to claim 1, wherein a susceptor of the second set of susceptors is longer, measured parallel to a longitudinal axis of the heating chamber, than a susceptor of the first set of susceptors.

8. The heater assembly according to claim 1, wherein a susceptor of the second set of susceptors comprises a thinner distal portion and a broader proximal portion, and wherein proximal refers to a direction closest to a user and distal refers to a direction away from the user.

9. The heater assembly according to claim 1, wherein a susceptor of the second set of susceptors forms a paddle-like shape.

10. The heater assembly according to claim 1, wherein a gap is provided between heating surfaces of the susceptors of the first set of susceptors and heating surfaces of the susceptors of the second sets of susceptors.

11. The heater assembly according to claim 1, wherein a gap is provided between heating surfaces of the susceptors within one or both of the first and the second set of susceptors.

12. The heater assembly according to claim 1, wherein a shape of a susceptor of the first set of susceptors differs from a shape of a susceptor of the second set of susceptors.

13. The heater assembly according to claim 1, wherein the first and the second sets of susceptors are mounted on a common base arranged at a distal end of the heating chamber.

14. An aerosol-generating device comprising a heater assembly comprising:

a heating chamber configured to heat an aerosol-forming substrate, the heating chamber including a longitudinal axis;

a first set of two or more susceptors configured to heat a first heating zone of the heating chamber;

a second set of two or more susceptors configured to heat a second heating zone of the heating chamber; and a first inductor coil arranged to heat the first set of susceptors and a second inductor coil arranged to heat the second set of susceptors, with the first inductor coil positioned at a different position along the longitudinal axis of the heating chamber from the second inductor coil, wherein the first heating zone and the second heating zone are arranged at different longitudinal positions of the heating chamber, wherein the first set of susceptors is spaced apart from the second set of susceptors such that the first set of susceptors is not connected to the second set of susceptors by a susceptor material, and wherein each susceptor in the first set of susceptors and the second set of susceptors is mounted on a common support.

15. An aerosol-generating system comprising:

an aerosol-generating device comprising a heater assembly comprising:

a heating chamber configured to heat an aerosol-forming substrate, the heating chamber including a longitudinal axis;

a first set of two or more susceptors configured to heat a first heating zone of the heating chamber;

a second set of two or more susceptors configured to heat a second heating zone of the heating chamber; and a first inductor coil arranged to heat the first set of susceptors and a second inductor coil arranged to heat the second set of susceptors, with the first inductor coil positioned at a different position along the longitudinal axis of the heating chamber from the second inductor coil, wherein the first heating zone and the second heating zone are arranged at different longitudinal positions of the heating chamber, wherein the first set of susceptors is spaced apart from the second set of susceptors such that the first set of susceptors is not connected to the second set of susceptors by a susceptor material, and wherein each susceptor in the first set of susceptors and the second set of susceptors is mounted on a common support; and an aerosol-generating article comprising an aerosol-forming substrate, wherein the aerosol-generating article is configured to be at least partly inserted into the heating chamber.

* * * * *